US009532642B2

(12) United States Patent
Zech

(10) Patent No.: US 9,532,642 B2
(45) Date of Patent: Jan. 3, 2017

(54) HOLLOW MASCARA BRUSH

(71) Applicant: GEKA GmbH, Bechhofen (DE)

(72) Inventor: Christina Zech, Ellingen (DE)

(73) Assignee: GEKA GmbH, Bechhofen (DE)

( * ) Notice: Subject to any disclaimer, the term of this patent is extended or adjusted under 35 U.S.C. 154(b) by 224 days.

(21) Appl. No.: 14/349,891

(22) PCT Filed: Oct. 2, 2012

(86) PCT No.: PCT/EP2012/069492
§ 371 (c)(1),
(2) Date: Apr. 4, 2014

(87) PCT Pub. No.: WO2013/050386
PCT Pub. Date: Apr. 11, 2013

(65) Prior Publication Data

US 2014/0283868 A1 Sep. 25, 2014

(30) Foreign Application Priority Data

Oct. 4, 2011 (DE) ..... 20 2011 106 282 U

(51) Int. Cl.
*A46B 9/02* (2006.01)
*A46B 3/00* (2006.01)
(Continued)

(52) U.S. Cl.
CPC ..... *A46B 9/021* (2013.01); *A46B 3/005* (2013.01); *A46B 11/0006* (2013.01);
(Continued)

(58) Field of Classification Search
CPC ..... A45D 2/002; A45D 24/00; A45D 24/02; A45D 24/04; A45D 24/06; A45D 24/22; A45D 40/26; A45D 40/262; A45D 40/265; A45D 40/267; A46B 11/0006; A46B 13/003; A46B 2200/1053; A46B 2200/106; A46B 3/005; A46B 5/0025; A46B 9/021; A46D 1/0253
(Continued)

(56) References Cited

U.S. PATENT DOCUMENTS 159,004 A * 1/1875 Wilkins ..... A45D 24/36 132/131
527,509 A * 10/1894 Rheinberg ..... A45D 24/02 132/139
(Continued)

FOREIGN PATENT DOCUMENTS

DE 20-2012011645 * 3/2013
EP 1593320 A1 11/2005
(Continued)

*Primary Examiner* — Rachel Steitz
*Assistant Examiner* — Jennifer Gill

(57) ABSTRACT

An applicator for applying a cosmetic to eyelashes, comprising a shaft section or at least a coupling section and an applicator section, the applicator section being configured as an internally hollow cage for accommodating the cosmetic, which is substantially or completely closed in the circumferential direction, characterized in that the cage, in the direction perpendicular to its longitudinal axis, has a triangular cross section and comprises on at least one of its circumferential tips a number of passages that communicate with the interior of the cage and into which the eyelashes insert themselves during application.

12 Claims, 10 Drawing Sheets

(51) Int. Cl.
*A46B 11/00* (2006.01)
*A46D 1/00* (2006.01)
*A46B 15/00* (2006.01)

(52) U.S. Cl.
CPC ..... *A46D 1/0253* (2013.01); *A46B 15/0059* (2013.01); *A46B 2200/106* (2013.01)

(58) Field of Classification Search
USPC ..... 132/116, 138–139, 150, 160, 216, 218, 132/317, 318; D28/28
See application file for complete search history.

(56) References Cited

U.S. PATENT DOCUMENTS 1,094,013 A * 4/1914 Peterson ..... A45D 24/02 132/137
1,486,688 A * 3/1924 Roscher ..... A45D 24/02 132/159
1,707,665 A * 4/1929 Julien ..... A45D 19/02 132/112
2,101,132 A 12/1937 Daly et al.
2,678,047 A * 5/1954 Garfield ..... B26B 19/00 132/129
2,762,382 A * 9/1956 Morgan, Sr. ..... A45D 2/002 132/148
2,763,895 A * 9/1956 Iesersek ..... A45D 24/04 132/159
2,883,994 A * 4/1959 Angelini ..... A45D 24/04 132/138
3,459,199 A * 8/1969 Connell ..... A45D 24/10 132/119.1
3,669,130 A * 6/1972 Petroczky ..... A45D 24/02 132/138
3,998,235 A * 12/1976 Kingsford ..... A45D 34/00 132/218
4,384,382 A * 5/1983 Diamant ..... A46B 9/005 15/104.001
4,744,377 A * 5/1988 Dolan, Jr. ..... A45D 40/265 132/218
5,386,839 A * 2/1995 Chen ..... A45D 24/04 132/152
6,581,610 B1 * 6/2003 Gueret ..... A45D 40/267 132/218
6,691,716 B2 * 2/2004 Neuner ..... A45D 40/267 132/218
7,467,905 B2 12/2008 Habatjou
7,810,509 B2 * 10/2010 Kuzuu ..... A46B 9/021 132/218
D640,000 S * 6/2011 Limongi ..... D28/7
D656,738 S * 4/2012 Limongi ..... D4/128
8,191,559 B2 * 6/2012 Bickford ..... A45D 40/265 132/218
D664,361 S * 7/2012 Edmondson ..... D4/128
2002/0005209 A1 * 1/2002 Gueret ..... A45D 40/267 132/218
2005/0011532 A1 1/2005 Gueret
2005/0249539 A1 * 11/2005 Habatjou ..... A45D 40/265 401/127
2007/0079842 A1 * 4/2007 Glynn ..... A45D 20/00 132/108
2009/0071499 A1 * 3/2009 Wyatt ..... A45D 40/265 132/218
2009/0159094 A1 6/2009 Dumler
2012/0034015 A1 * 2/2012 Kudo ..... A45D 24/22 401/143

FOREIGN PATENT DOCUMENTS

EP 2071977 A1 6/2009
FR 2378472 * 8/1978
JP 2000-23738 A 1/2000

* cited by examiner

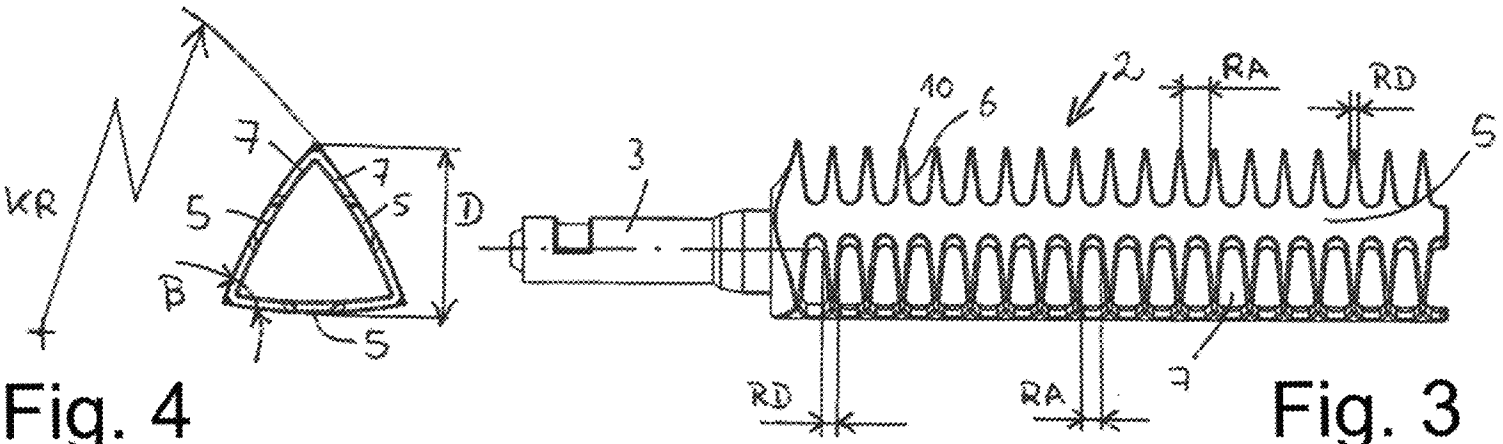
Fig. 4
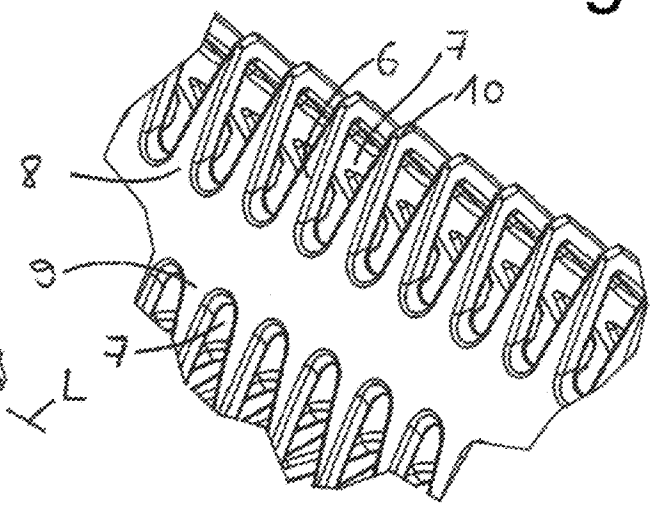
Fig. 3
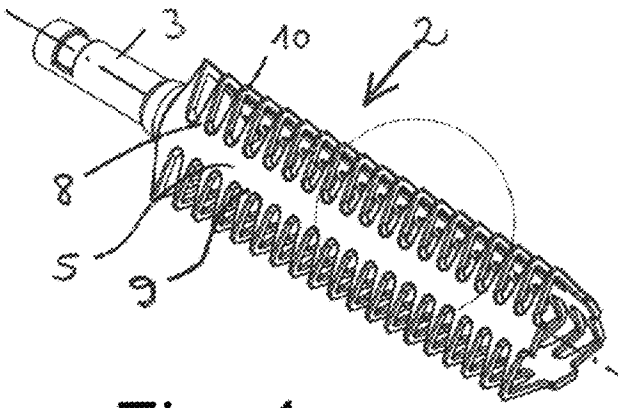
Fig. 2
Fig. 1

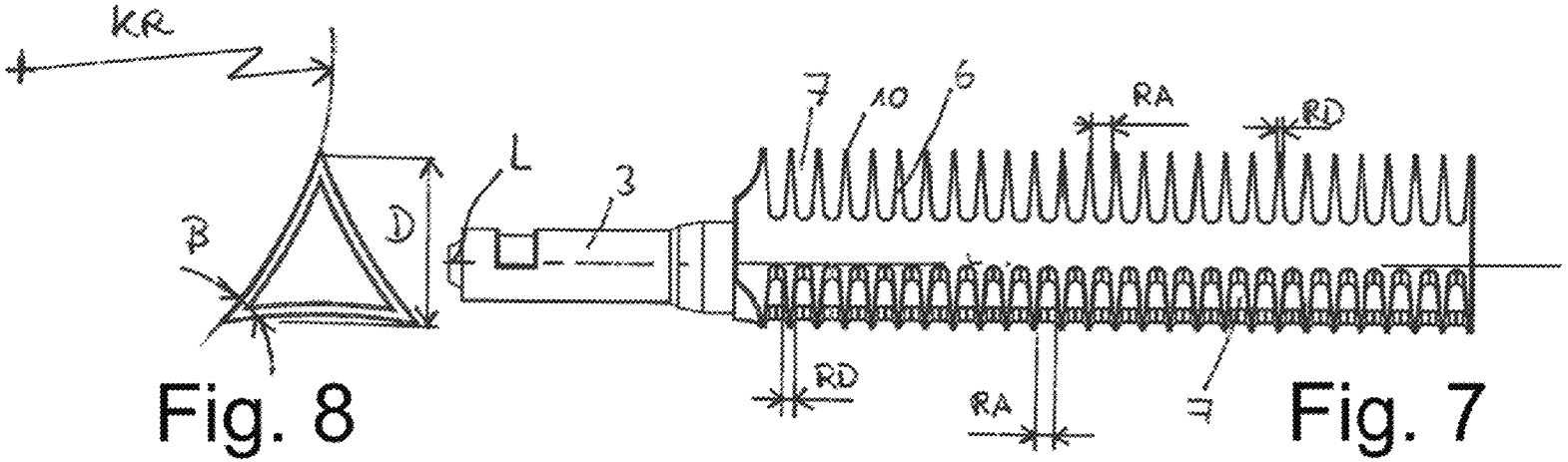
Fig. 8
Fig. 7
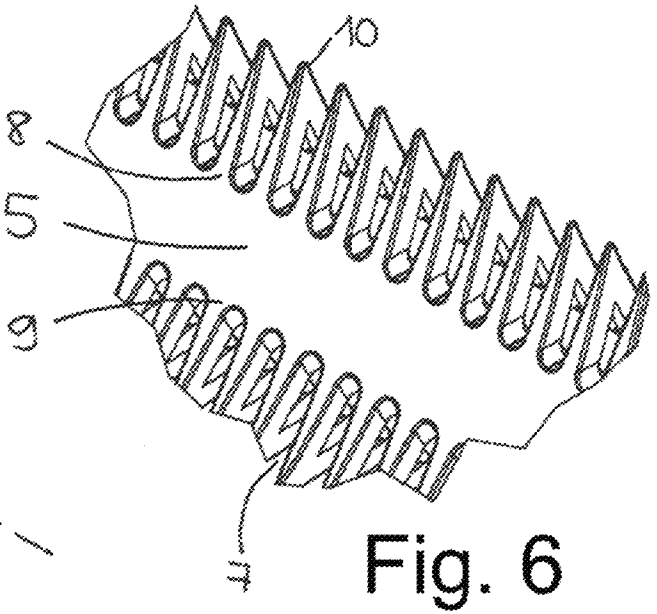
Fig. 6
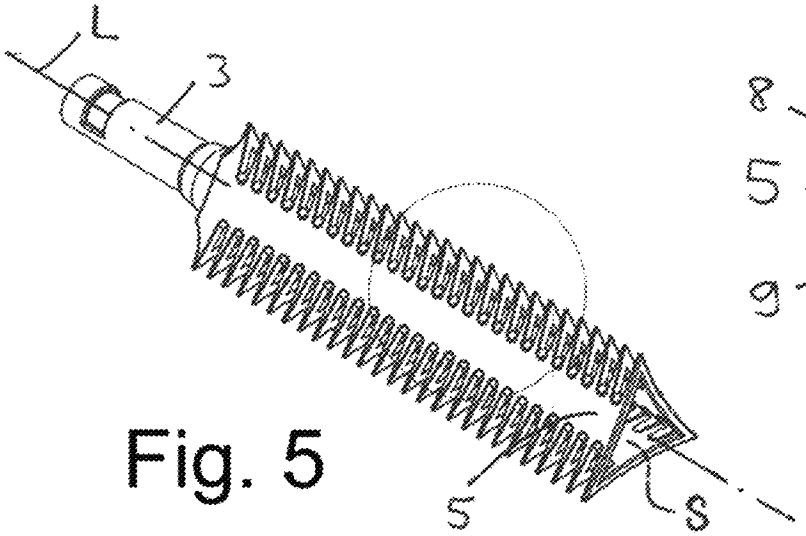
Fig. 5

HOLLOW MASCARA BRUSH

FIELD OF THE INVENTION

The invention relates to an applicator. Such an applicator serves for applying a cosmetic to keratin fibers, and in particular for applying mascara to the eyelashes of the human eye.

BACKGROUND OF THE INVENTION

In addition to bristle-covered applicators, in particular so-called disk applicators are known in the prior art. The actual applicator section in such disk applicators comprises a core with a not inconsiderable thickness, from which a number of disks or disk portions protrudes outwards in the radial direction. A free space is respectively provided between adjacent disks or disk members. The predominant part of the cosmetics mass to be applied remains, in particular, in this free space even after the applicator has been pulled out from the cosmetics storage container and after wiping the applicator. If, for example, such an applicator is brought up close to the eyelashes of the human eye, the eyelashes insert themselves into the free spaces between the individual disks and their surface is wetted with the cosmetic as soon as the applicator is rotated or pulled back again from the eye. The European patent application EP 2 071 977 describes an example for such a disk applicator.

Application results that are quite satisfactory can be achieved with such disk applicators, but further improvement is still needed for certain cases of use:

Due to their core, such disk applicators have a relatively large diameter, which is why it is difficult in some cases to ensure that the eyelashes are treated with the cosmetic up to the ends thereof on the side of the eyelid.

In other cases, the mass storage capacity of the known disk applicators needs to be improved.

A solution for the above mentioned problems is achieved with the features of the mascara brush described herein.

SUMMARY OF THE INVENTION

Accordingly, an applicator for applying a cosmetic to eyelashes is proposed, which comprises a shaft section or at least a coupling section and an applicator section. Here, the applicator section is configured as an internally hollow cage for accommodating the cosmetic, which is substantially or completely closed in the circumferential direction. According to the invention, such an applicator is characterized in that the cage, in the direction perpendicular to its longitudinal axis L, has a triangular cross section and comprises on at least one of its tips, which are to be found on the circumference due to this cross-sectional shape, a number of passages that communicate with the interior of the cage and into which the eyelashes insert themselves during application.

A tip equipped with passages can be brought up close to the point of attachment of the eyelashes on the side of the lid much better than a uniformly cylindrical applicator—because only the tip comes particularly close to the eye, but not the entire applicator. This is perceived by the users as being considerably more comfortable. In addition, such a tip generally is particularly well-suited for combing the eyelashes.

Alternatively, an applicator is proposed which is also configured as an internally hollow cage for accommodating the cosmetic, which is substantially or completely closed in the circumferential direction. Here, the cross section of the cage comprises, perpendicular to the longitudinal axis L of the applicator section, at least one substantially V-shaped bulge comprised of two surfaces disposed at an angle to each other of preferably ≤110°, while the rest of the cross section does not necessarily have to match the triangular form but can be configured otherwise. In a similar manner as the tip of the triangular cross section, this bulge protrudes outwards and comprises a number of passages that communicate with the interior of the cage and into which the eyelashes insert themselves during application.

The classic heart-shape is a preferred exemplary embodiment for such a cross section with a V-shaped bulge—the tip of the heart forms said bulge, which can be brought up very closely to the point of attachment of the eyelashes on the side of the lid without any trouble, and which therefore functionally corresponds to the tip of the triangular cross section described in the introduction.

As another alternative solution, an applicator is proposed whose applicator section is again configured as an internally hollow cage for accommodating the cosmetic, which is substantially or completely closed in the circumferential direction, wherein the cross section comprises, perpendicular to the longitudinal axis L of the applicator section, at least one substantially convex bulge that protrudes outwards and comprises a number of passages that communicate with the interior of the cage and into which the eyelashes insert themselves during application.

Such an applicator generally will comprise a circular or oval overall cross section, over which, similar to the petals of a flower, several bulges having the shape of a circle segment protrude outwards. Each such bulge has a more pronounced convex curvature compared with the surroundings of the bulge and therefore also forms a region that can be brought up close to the point of attachment of the eyelashes on the side of the lid—without having to bring to entire applicator uncomfortably close to the eye.

In another embodiment of the invention, it is provided that the cage is formed by a coil preferably consisting of metal on which a shaft section or at least a coupling section of plastic is molded on. It thus becomes possible to realize extremely thin and/or extremely flexible ribs that exhibit special usage characteristics and produce a completely novel application feeling.

Further optional embodiments, mechanisms of action and advantages become apparent from the description of a total of nine exemplary embodiments given below with reference to the Figures.

BRIEF DESCRIPTION OF THE DRAWINGS

In the Figures:

FIG. 1 is a perspective view of a first embodiment with a triangular cross-section;

FIG. 2 is a magnified view of FIG. 1;

FIG. 3 is a side view of the device of FIG. 1;

FIG. 4 is an end view of the device of FIG. 1;

FIG. 5 is a perspective view of a second embodiment with a triangular cross-section;

FIG. 6 is a magnified view of FIG. 5;

FIG. 7 is a side view of the device of FIG. 5;

FIG. 8 is an end view of the device of FIG. 5;

DETAILED DESCRIPTION OF THE PREFERRED EMBODIMENTS

Figure 11:
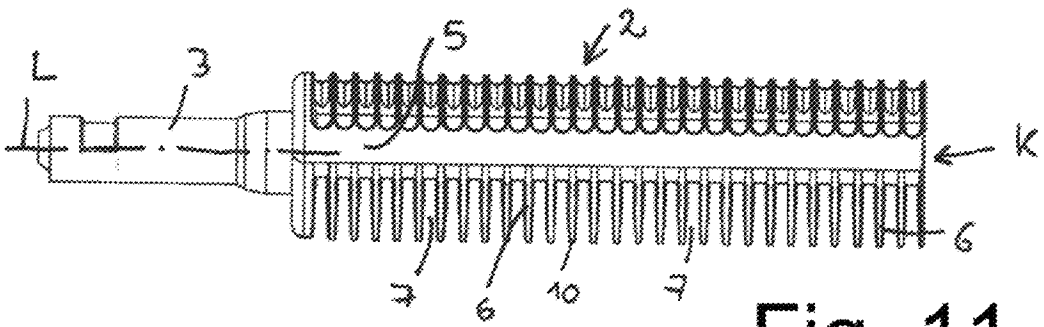
FIG. 11 is a side view of the device of FIG. 9.

FIGS. 1 to 4 show a first exemplary embodiment of the invention.

As can be seen, the actual applicator 1 is comprised of an applicator section 2 in the shape of the preferably completely core-less cage K, which is to be explained in detail below, and a coupling section 3. The applicator 1 is coupled by means of the coupling section 3 to a stem, which is not shown here and which establishes a connection with a handle, which is also not shown here.

The proximal end face 4*a* of the applicator section 2, i.e. the end face facing towards the coupling section 3, is adjacent to the coupling section 3. In this exemplary embodiment, three carrier members 5 are attached to this proximal end face 4*a*, preferably by integral production with the end face 4*a* in an injection-molding process. The proximal end face 4*a* is completely closed and thus retains the cosmetic mass entering the cavity of the cage K. The distal end face 4*b* of the applicator section is substantially completely open and thus offers a large cross section via which the cosmetic mass can enter the interior of the cage K when the applicator section 2 is dipped or pushed in again.

The closed cage with its triangular cross section, which characterizes this exemplary embodiment, is immediately noticeable. In this case, the individual circumferential surfaces delimiting the triangular cage are preferably configured in a convex or concave manner (see FIG. 4), with the radius of curvature KR, which determines this convex or concave curvature, being preferably greater by at least a factor of 2.5, better by at least a factor of 3, than the maximum extent D of the cage perpendicular to the longitudinal axis L.

The coupling section 3 and the applicator section 2 of this exemplary embodiment can be integrally injection-molded from a plastic material. Ideally, the clear internal cross section of the cage in that case has a slight conicity, i.e. the clear internal cross section of the cage increases slightly towards the distal end of the cage.

The wall portions of the cage preferably all have substantially the same wall thickness.

There are wall portions of the cage in some regions which are not perforated and which form the carrier members 5 in this manner. Each of these wall portions forming a carrier member 5 is preferably situated centrally on one of the plane or slightly convex or concave circumferential surfaces of the cage. Ideally, the ribs are uniformly or substantially uniformly distributed over the circumference. Cage designs comprised of a number of triangular ribs 6 disposed parallel to each other, which are connected to each other only on one side by means of a carrier member, are not excluded from the outset, but are not preferred.

Two carrier members 5, respectively, are connected to each other by means of ribs 6 that respectively extend from one carrier member to the other carrier member. Adjacent ribs 6 are spaced apart from each other, so that one passage 7, respectively, is formed between adjacent ribs that connects the outer surface of the cage K extending in the circumferential direction with the hollow interior thereof, and via which the eyelashes can come into the region of the hollow interior of the cage—even if they are not radially orientated but rest on two different carrier members 5 and thus cross the interior of the cage only in the manner of a secant. This definition of the passage 7 applies equally to all exemplary embodiments.

The ribs are preferably characterized in that each rib is two-legged and the two legs that start from the respective rib base point 8 or 9 and meet in the apex 10 of the respective rib include an acute angle β, which is preferably less than or equal to 80 degrees, see FIG. 4.

Preferably, the triangular cage is opened towards the outside in each of its tip regions on the circumferential side, that is, it comprises on each of its tip regions an alternating sequence of ribs 6 and passages 7. However, it may theoretically be sufficient in some cases if the triangular cage is opened towards the outside circumferentially only in one of its tip regions; in that case, this would rather have to be referred to as a unilaterally opened triangular tube. However, such an embodiment is not preferred.

The apex 10 of each rib 6 preferably comprises a flattened or rounded portion, which generally will be dimensioned in such a way that the apexes 10 do not produce an unpleasant "pricking" when coming into contact with the sensitive eyelid.

As can be seen in the Figures, the extent of the ribs 6 (measured in the direction parallel to the longitudinal axis L of the applicator) preferably decreases from the respective rib base point towards the respective rib apex point. In this way, the free space between two ribs 6 that are adjacent in the longitudinal direction L in each case forms a V-shaped passage 7, i.e. a passage that is ideal for "capturing" eyelashes. It is precisely this design that permits the applicator to be brought up very closely to the end of the eyelashes on the side of the lid, so that the treated eyelashes are cleanly wetted with the cosmetic. This is the decisive advantage over an otherwise comparable round applicator. Such a round applicator would have to have an extremely small diameter in order to be capable of being brought up comparably closely to the point of attachment of the eyelashes. However, the choice of an extremely small diameter would then affect its mass storage capacity in a disadvantageous manner, because the free inner space of the cage becomes the smaller the more the diameter decreases.

In this exemplary embodiment, the rib spacing RA in the region of adjacent rib apexes 10 is at least 3 times, better still at least 4 times the rib extent RD in the region of the rib apex, measured in the direction parallel to the longitudinal axis L. In this exemplary embodiment, the rib spacing RA in the region of adjacent rib base points (above the base-side rounded portion) is preferably at least 0.75 time, better still at least 1.25 times the rib extent RD in that region, measured in the direction parallel to the longitudinal axis L.

Preferably, the cage is comprised of at least one, preferably three rows of, in each case, 10 to 30, better 12 to 20 ribs 6 that are disposed one behind the other in the longitudinal direction L. Ideally, all ribs are the same.

Preferably, the cross section of the cage does not form an equilateral triangle, but a triangle in which at least one of the side lengths is greater than the other two side lengths.

In this way, different sides can be given different usage characteristics. Ideally, at least one side of the triangle has an edge length KL of ≤12 mm, better still an edge length KL of ≤8 mm.

The extent of the applicator 2 in the direction of its longitudinal axis, not including the coupling section, preferably is ≤35 mm, better still ≤30 mm.

If the applicator shown in FIGS. 1 to 4 is manufactured from plastic, the cross-sectional surface area of the individual ribs is preferably selected to be so small, in accordance with the material used for the ribs, that the individual ribs are not completely rigid, but that they can be bent a bit towards the side in the direction of the longitudinal axis L of the applicator by the wiper during wiping. As a consequence, the applicator section does not present itself after wiping as a continuously smooth-surfaced cylinder that is completely filled with the cosmetic mass, but that certain areas are created between the ribs that are free from the stored cosmetic mass, so that the loaded and completely wiped-off applicator section is reminiscent, at least in some regions, of a furrowed applicator.

Preferably, each individual rib is dimensioned in such a way, in accordance with the rib material, that the rib is able to be displaced in the region of its rib apex by an amount B in the direction of the longitudinal axis L. The FIG. 3 illustrates what this means. The amount B preferably corresponds at least to the extent of the individual rib in the direction of the longitudinal axis L, and preferably even to twice or ideally even at least three times this extent.

The cage K, which is formed in the above described manner from the carrier sections 5 and the ribs 6 connecting them, is thin-walled compared to its diameter—the wall thickness of the ribs forming the cage in the radial direction is never more than 17.5% of that of the cage diameter, preferably never more than 10% of the cage diameter. The cage diameter, given a non-round applicator cross section, is understood to be the diameter of that imaginary circle that has the same surface area as the actual cage cross section.

In conclusion, it is to be noted that the portion of the entire outer circumferential surface of the cage K (minus the surface area of the carrier members 5) made up by the outwardly facing rib surface is preferably smaller than the imaginary surface occupied by the passages 7 on the outer circumferential surface of the cage K. Preferably, the ratio "rib surface area" to "surface area of the passages" is even less than 40%.

It is also to be noted that at least those ribs that form one side of the triangular cross section can be configured in such a way that they form an additional groove 16, as it is shown in FIGS. 13 to 16, which are yet to be explained in more detail within the context of the fourth embodiment. The statements within the context of the fourth exemplary embodiment in this regard also apply here mutatis mutandis.

One variation of the applicator of the present invention is manufactured in the so called two-component injection-molding process. During this process, the carrier members 5 that provide the applicator with a substantial part of its rigidity and/or dimensional stability are first injection-molded from a harder and/or more rigid plastic. In a second step, the ribs, which consist of a softer and/or more flexible plastic, are injection-molded thereon. The individual usage characteristics of the applicator can thus be adjusted precisely.

The applicator shown by this exemplary embodiment does not have to be designed as a preferably integral injection-molded plastic part, even though a manufacture of this type is, of course, very advantageous with regard to aspects of cost.

Instead, high-priced applicators of this type can also consist of metal.

They are preferably manufactured in a metal die casting process or by one of the primary forming processes that are otherwise used for the co-called "rapid prototyping" of metal-containing materials.

Preferably, an applicator section manufactured in this manner from metal receives a finish by being guided with its outermost circumference past a grinding wheel so that its pointed apex regions are rounded off, which ensures a more pleasant application feeling and greater safety.

FIGS. 5 to 8 show a second exemplary embodiment of the invention, which substantially matches the first exemplary embodiment and to which, therefore, the statements in connection with the first exemplary embodiment equally apply. In this case, the sole difference is that the cage in this exemplary embodiment is not completely closed in the circumferential direction but instead has, by way of exception and as a delimitation to all other exemplary embodiments, a slot extending in the longitudinal direction over the width of several ribs, as can best be seen in FIG. 5. Preferably, the slot is designed to be so narrow that the effect of the inner space of the cage being loaded with cosmetic when the applicator section is pushed into a cosmetics supply is not significantly affected. In order to accomplish this, the slot, as can be seen in FIG. 8, is in this exemplary embodiment delimited by rudimentarily formed rib sections 12 which end at the edges of the slot S in a freely projecting manner.

FIGS. 9 to 12 describe a third exemplary embodiment of the invention that is very similar to the first exemplary embodiment of the invention. Therefore, what was already described there also applies mutatis mutandis to this third exemplary embodiment unless otherwise stated in the features described hereinafter, in which the third exemplary embodiment differs from the first exemplary embodiment.

In this third exemplary embodiment, the cage has a cross section corresponding to a heart shape, i.e. a substantially non-triangular cross section. With the tip of the heart, this heart-shaped cross section implements the idea set forth in the claims that the cross section of the cage comprises, perpendicular to the longitudinal axis L of the applicator section, at least one substantially V-shaped bulge comprised of two surfaces disposed at an angle to each other of preferably ≤110°, better ≤90°, which protrudes outwards, and which comprises a number of passages 7.

Thus, an applicator with such a cross section, which is non-triangular on the whole, at least locally achieves the advantages that the above-described triangular cross section has achieved. Furthermore, this heart-shaped cross section has further advantages in individual cases.

Again, the wall thickness of the cage is preferably the same everywhere. However, there is a total of three regions in which the cage wall has no interruptions or passages, which is why it forms a carrier member 5 in each case in these locations.

The ribs 6, which in this exemplary embodiment form the tips of the heart-shaped cross section, are again preferably characterized in that each of these ribs 6 is two-legged and the two legs that start from the respective rib base point 8, 9 and meet in the apex 10 of the respective rib include an angle β, which is preferably less than or equal to 110°.

Respectively adjacent ribs of this type form a penetrating passage 7 between them. As was already described above in connection with the first exemplary embodiment, the point of attachment of the eyelashes on the side of the lid can be reached very well with the passages formed between these ribs, so that a treatment of the eyelashes directly up to their point of attachment is ensured.

As regards the rib spacing and the rib cross section as well as the rigidity of the ribs, the statements pertaining to the first exemplary embodiment, in particular, apply here.

It is to be noted that in this exemplary embodiment an additional channel 11 is produced in the region in which the two heart chambers meet, in which additional mass can be stored directly on the outer circumference of the cage.

This heart-shaped embodiment has the great advantage that sections of the cage are available that are curved in different degrees, so that this applicator, depending on which position it is turned into, exhibits very different usage characteristics, thus uniting in itself the markedly different characteristics of several different applicators.

FIGS. 13 to 16 describe a fourth exemplary embodiment of an applicator according to the invention. This fourth exemplary embodiment largely matches the third exemplary embodiment, so that the statements respectively made there apply mutatis mutandis also to the fourth exemplary embodiment.

The difference of this fourth exemplary embodiment to the third exemplary embodiment lies in the fourth exemplary embodiment having an additional groove 16 in the region of the tip of the heart. This additional groove 16 is very narrow; the width of its clear cross section perpendicular to the longitudinal axis of the applicator approximately matches the thickness of a rib 6. With this additional groove, the tips of the eyelashes can be gripped or threaded very well in order to subject the eyelashes to a curling.

In order to prevent the ribs from becoming too unstable in the region of the tip of the heart, they are connected to one another in the groove bottom of said additional groove 16 by an additional carrier member 5.

FIGS. 17 to 20 describe a fifth exemplary embodiment of the applicator according to the invention, which, to be precise, is a variation of the third exemplary embodiment, so that the statements there also apply here.

Figure 18:
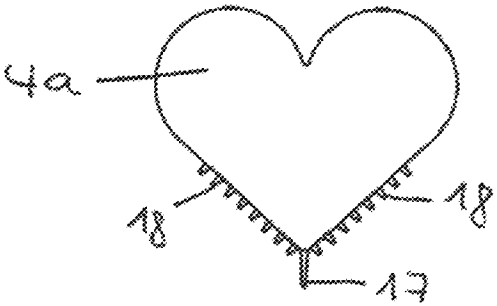
FIG. 18 is an end view of FIG. 17.
Figure 17:
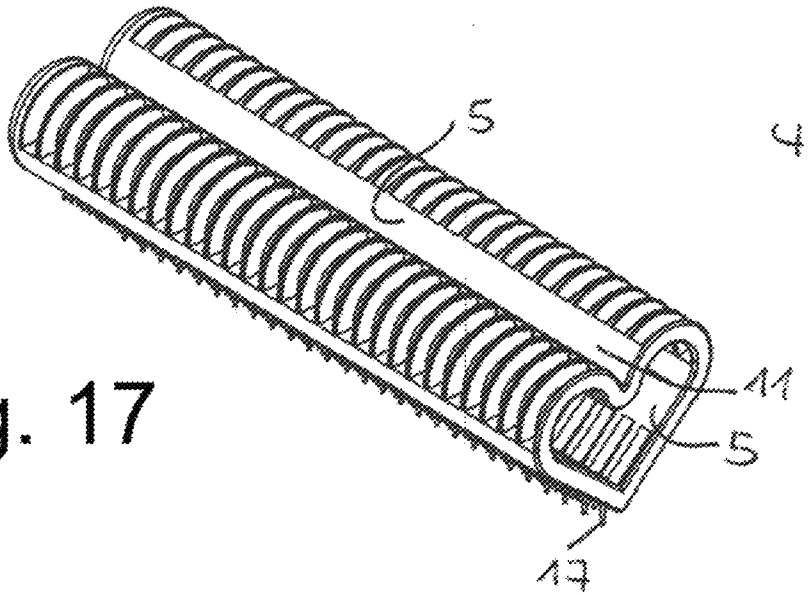
FIG. 17 is a perspective view of a fifth embodiment, which is a slight modification of the third embodiment.
Figure 20:
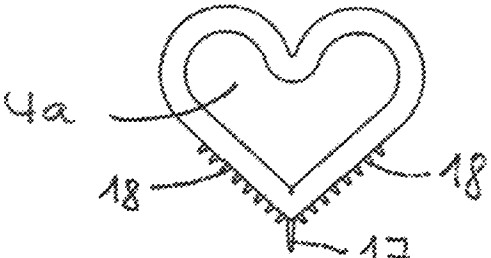
FIG. 20 is another end view of the device of FIG. 17.
Figure 23:
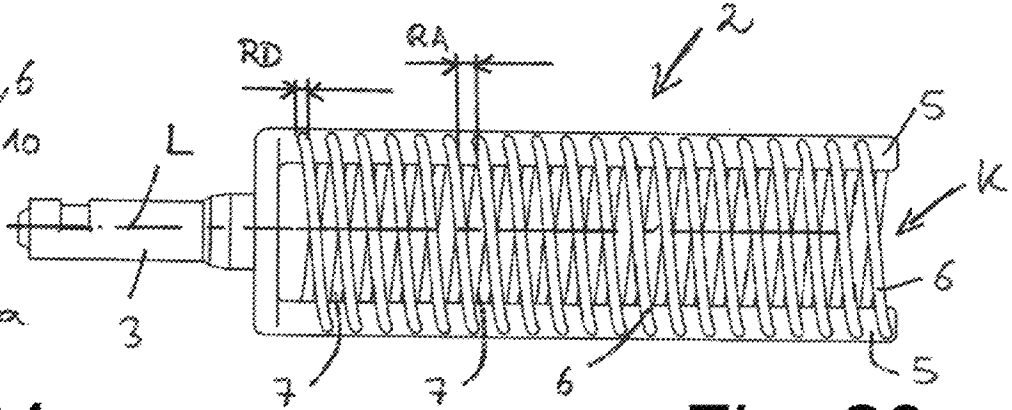
FIG. 23 is a side view of the device of FIG. 17.

As can best be seen in FIGS. 17, 18 and 20, the ribs 6 are each equipped with comb teeth 17 and retaining means 18.

The comb teeth 17 protrude outwards from the apex 10 of the ribs 6 forming the tip of the heart. The comb teeth improve the separation of the eyelashes when they are pulled from the passages 7 again. Since the comb teeth, at least in the region of their tips, have a diameter that is smaller than the thickness of the ribs 6 in the region of their apex 10, the comb teeth are very fine and can therefore be used to separate the eyelashes also subsequently, if required, without the eyelashes again dipping into the passages 7. Thus, also adjacent eyelashes can be separated from each other, for example, which had previously inserted themselves into the same passage 7 and which are therefore stuck to each other at first.

In this case, the retaining means 18 are configured in the form of short pins protruding outwards from the ribs. These pins preferably form a row of 10 to 20 pins on each rib. The length of the pins is preferably less than the thickness of the rib 6 in the corresponding direction. The pins improve the adherence of the cosmetic to the outside of the rib, thus contributing to loading each rib with a certain additional amount of cosmetic.

FIGS. 21 to 24 show a sixth exemplary embodiment of the invention.

As can be seen, the actual applicator 1 also in this embodiment is comprised of an applicator section 2 in the shape of the preferably completely core-less cage K, which is to be explained in detail below, and a coupling section 3. The applicator 1 is coupled by means of the coupling section 3 to a stem, which is not shown here and which establishes a connection with a handle, which is also not shown here.

The proximal end face 4*a* of the applicator section 2, i.e. the end face facing the coupling section 3, is adjacent to the coupling section 3.

In this exemplary embodiment, two carrier members 5 are attached to this proximal end face 4*a*, preferably by integral production with the end face 4*a* in an injection-molding process. The proximal end face 4*a* is completely closed and thus retains the cosmetic mass entering the cavity of the cage K. The distal end face 4*b* of the applicator section is substantially completely open and thus offers a large cross section via which the cosmetic mass can enter the interior of the cage K when the applicator section 2 is dipped or pushed in again. The two carrier members 5 are connected to each other by means of ribs 6 that respectively extend from one carrier member 5 to the other carrier member 5—each rib 6 has a first rib base point 8, with which it transitions into a first carrier member 5, and a second rib base point 9, with which it transitions into a second carrier member 5. The ribs 6 are spaced apart from each other, so that a passage 7 is formed, respectively, between two ribs that are adjacent in the direction of the longitudinal axis L. In this case, the ribs 6 are preferably disposed so as to extend parallel to each other, as FIG. 2 shows rather well. In this exemplary embodiment, the rib spacing RA is at least 1.5 times the rib diameter RD, measured in the direction parallel to the longitudinal axis L. The cross section of the individual ribs 6 is circular in this case.

The cross-sectional surface area of the individual ribs is preferably selected to be so small, in accordance with the material used for the ribs, that the individual ribs are not completely rigid, but that they can be bent a bit towards the side in the direction of the longitudinal axis L of the applicator by the wiper during wiping. As a consequence, the applicator section does not present itself after wiping as a continuously smooth-surfaced cylinder that is completely filled with the cosmetic mass, but that certain areas are created between the ribs that are free from the stored cosmetic mass.

Figure 22:
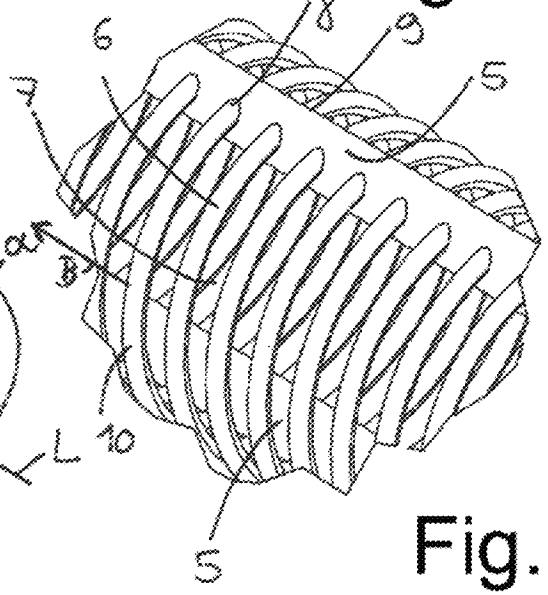
FIG. 22 is a magnified view of FIG. 17.
Figure 24:
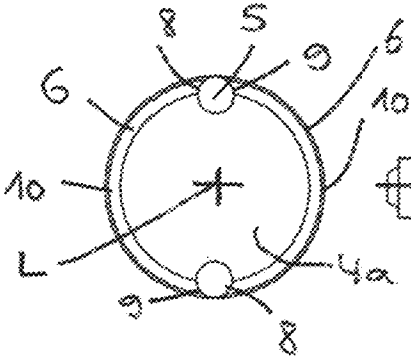
FIG. 24 is an end view of the device of FIG. 17.

Preferably, each individual rib is dimensioned in such a way, in accordance with the rib material, that the rib is able to be displaced in the region of its rib apex by an amount B in the direction of the longitudinal axis L. In this case, the rib apex 10 is the point that lies centrally between the two base points 8 and 9 of the respective ribs. The FIG. 22 illustrates what this means. The amount B preferably corresponds at least to the extent of the individual rib in the direction of the longitudinal axis L, and preferably even to twice or ideally even at least three times this extent.

The cage K formed in this manner is extremely thin-walled compared to its diameter—preferably, the thickness of each individual rib, or at least of the predominant number of the individual ribs (viewed in a perpendicular direction to the longitudinal axis L) is nowhere more than 15%, and ideally nowhere more than 10%, of the cage diameter.

If the cage cross section is not configured to be round, but non-round, as in another exemplary embodiment that is not depicted in a drawing, the same also applies, but with the term cage diameter being understood to mean, in the case of a non-round applicator cross section, the diameter of that imaginary circle that has the same surface area as the actual cage cross section.

Figure 21:
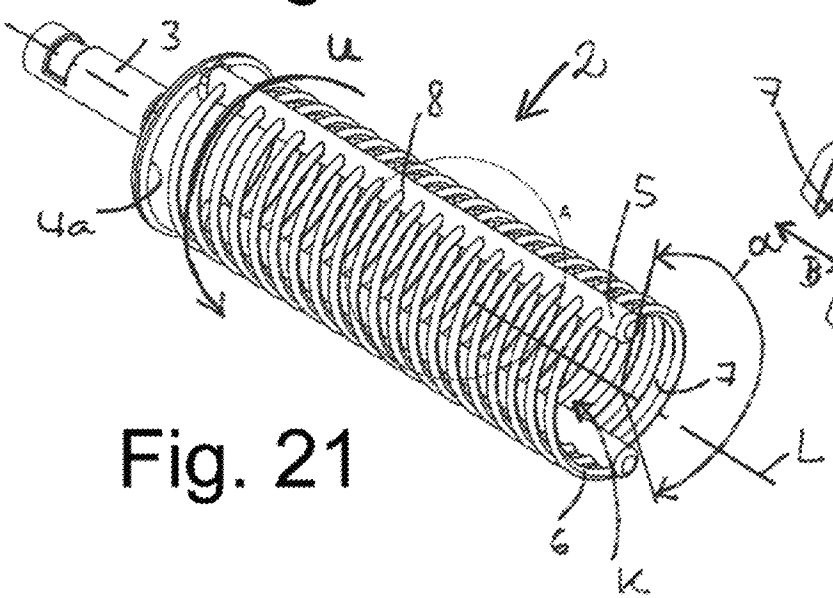
FIG. 21 is a perspective view of a sixth embodiment with ribs formed by a coil spring member.
Figure 27:
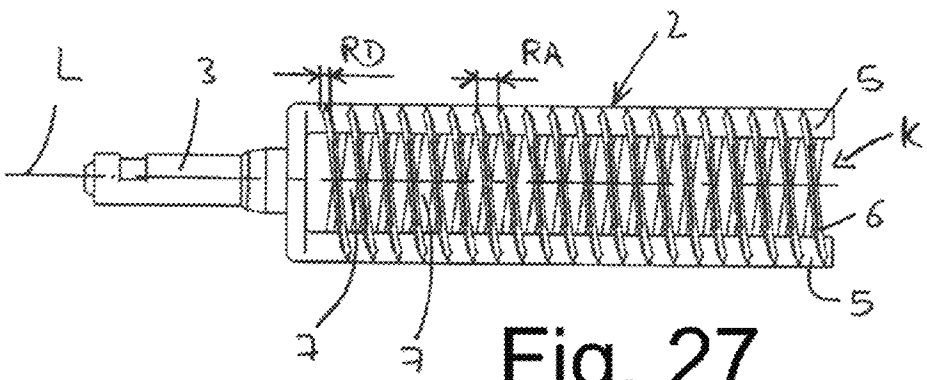
FIG. 27 is a side view of the device of FIG. 25.
Figure 26:
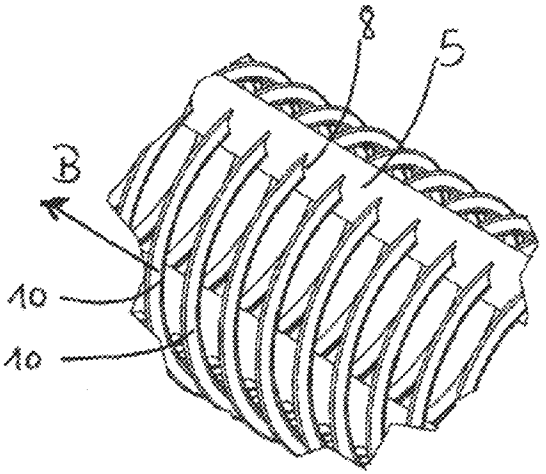
FIG. 26 is a magnified view of FIG. 25.
Figure 28:
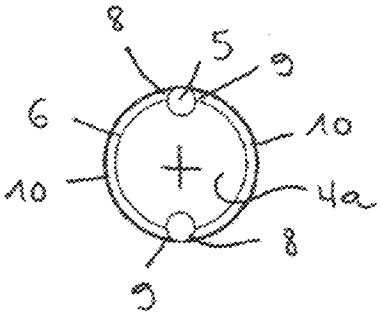
FIG. 28 is an end view of the device of FIG. 25.
Figure 25:
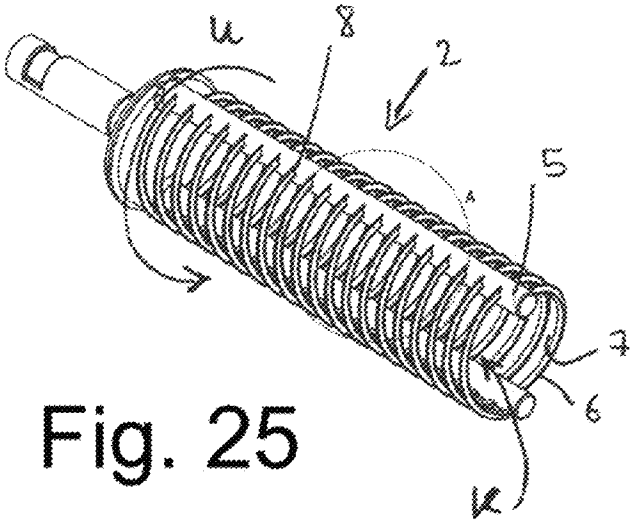
FIG. 25 is a perspective view of a seventh embodiment with ribs formed by a coil spring member.
Figure 31:
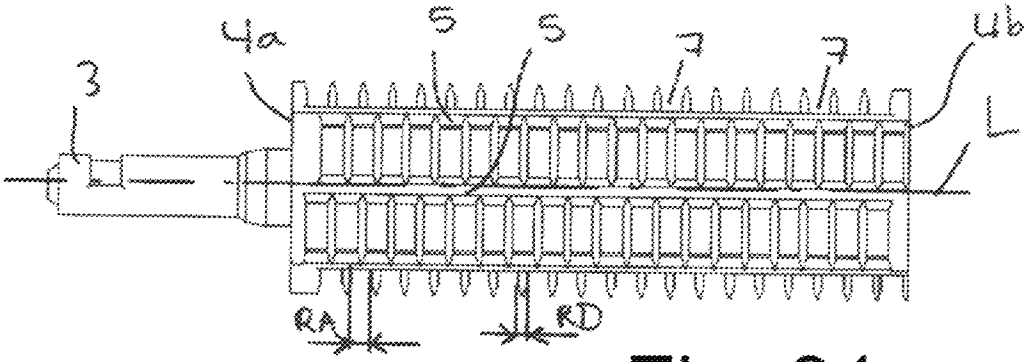
FIG. 31 is a side view of the device of FIG. 29.
Figure 30:
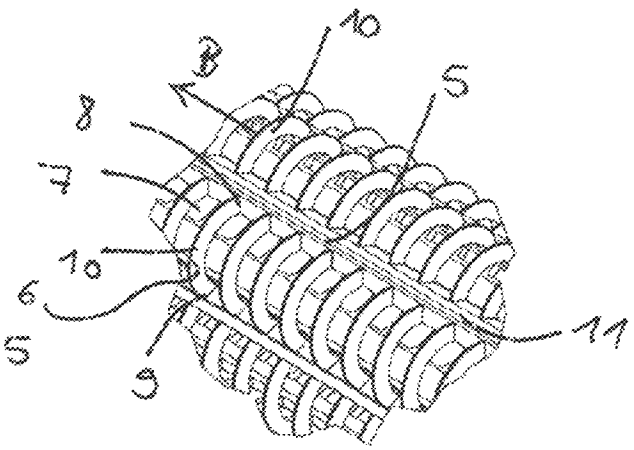
FIG. 30 is a magnified view of FIG. 29.
Figure 32:
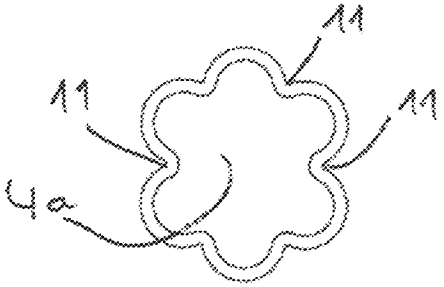
FIG. 32 is an end view of the device of FIG. 29.
Figure 29:
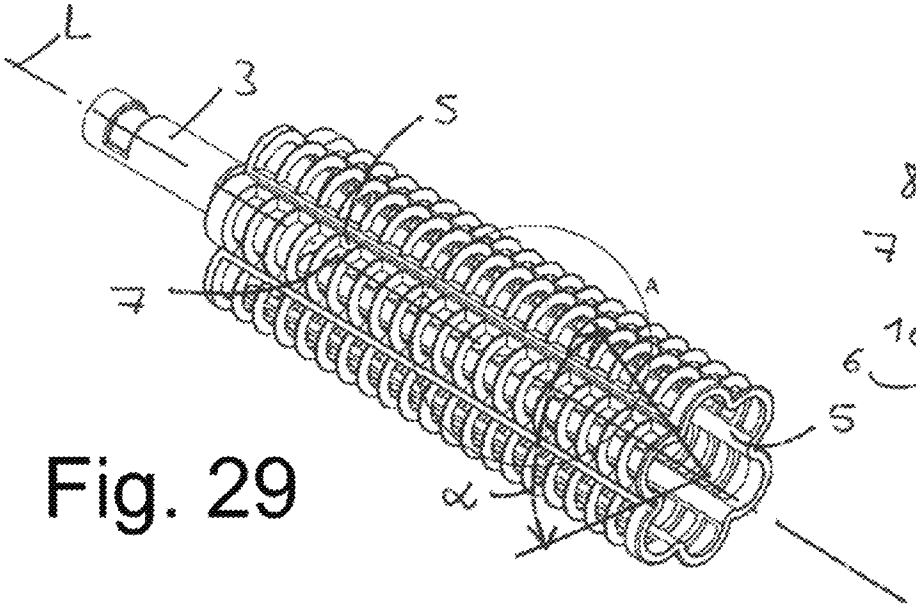
FIG. 29 is a perspective view of an eighth embodiment having a blossom-like cross-section.
Figure 35:
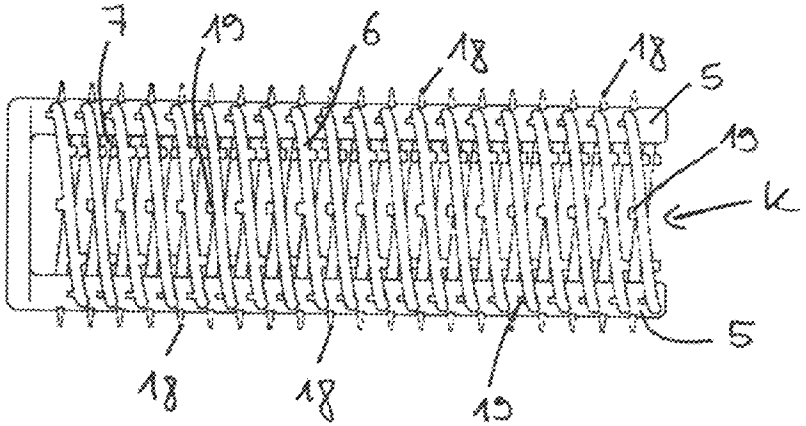
FIG. 35 is a side view of the device of FIG. 33.
Figure 34:
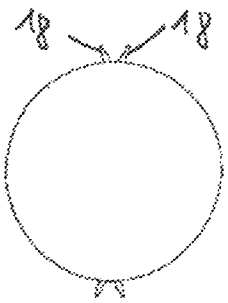
FIG. 34 is an end view of FIG. 33.
Figure 36:
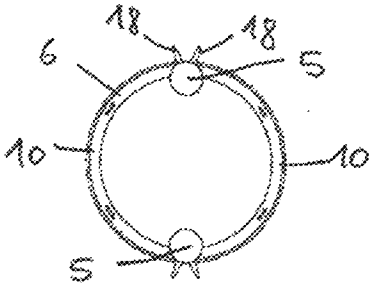
FIG. 36 is another end view of the device of FIG. 33.
Figure 33:
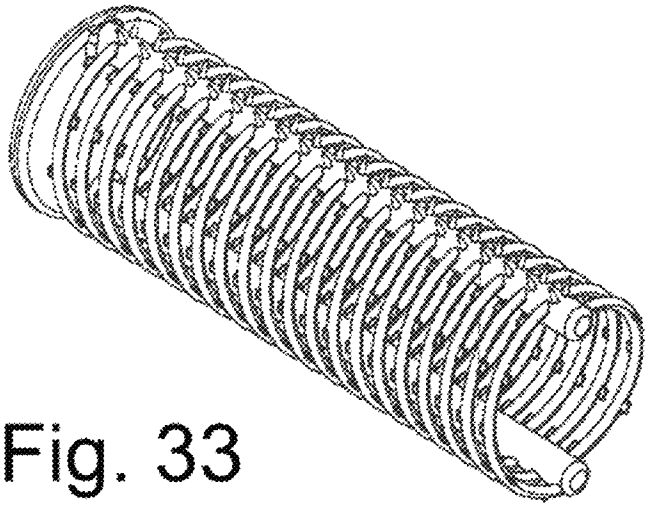
FIG. 33 is a perspective view of a tenth embodiment, which shows a modification of the sixth embodiment.
Figure 39:
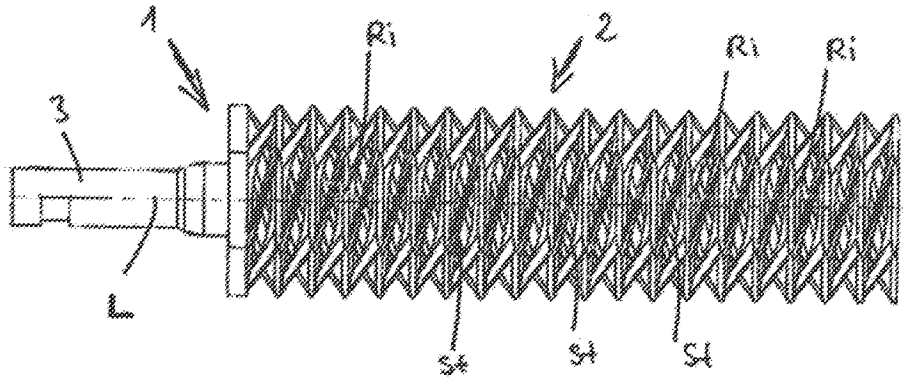
FIG. 39 is another side view of the device of FIG. 37.
Figure 38:
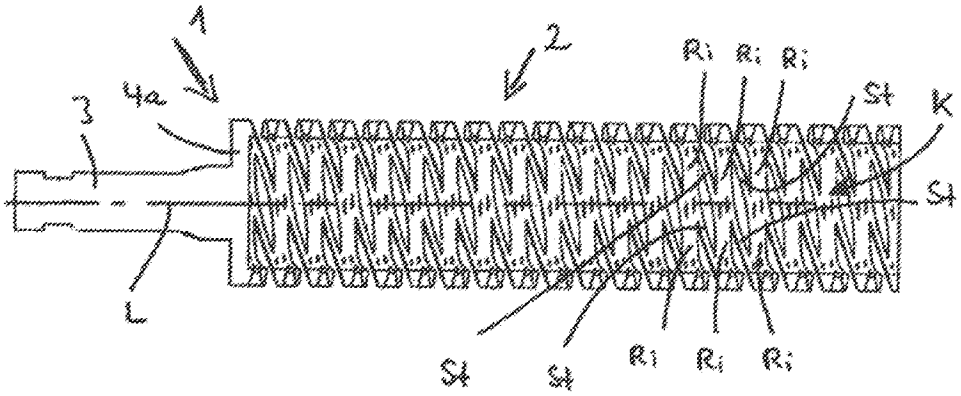
FIG. 38 is a cross-sectional view of the device of FIG. 37.
Figure 40:
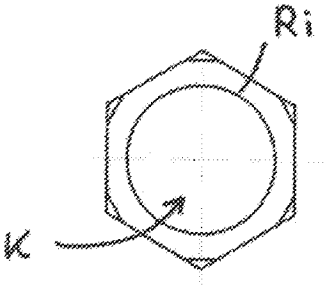
FIG. 40 is an end view of the device of FIG. 37.
Figure 37:
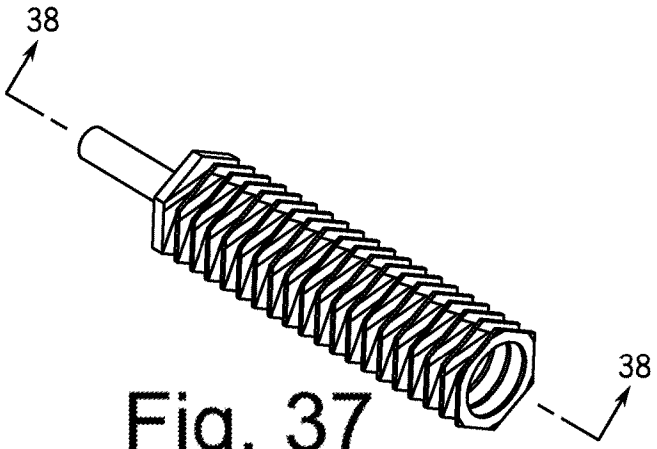
FIG. 37 is a perspective view of yet another embodiment.

As can be seen rather well in FIG. 21, the passages 7, viewed in the circumferential direction, extend without an interruption over an arc which in this case corresponds to an angle $\alpha$ of more than 160°. This makes clear that the eyelashes in such a core-less applicator, depending on how the applicator is brought up close to the eyelashes, are able to penetrate the applicator considerably more deeply and optionally also at a different angle than would be the case in a disk applicator. On the one hand, it is thus possible to bring the eyelashes into intensive contact with the cosmetic mass stored in the cavity of the cage, which, compared to a disk applicator, enables a more extensive charging of the eyelashes in a single working step. On the other hand, this embodiment makes it possible to guide the applicator in a different angle relative to the eyelashes, which entails a novel application feeling that is perceived as being positive by many test persons.

In conclusion, it is to be noted that the portion of the entire outer circumferential surface of the cage K made up by the outwardly facing rib surface is preferably smaller than the imaginary surface occupied by the passages 7 on the outer circumferential surface of the cage K; preferably, the ratio "rib surface area" to "surface area of the passages" is even less than 40%.

There are various suitable methods for producing the ribs or the entire applicator section. Particularly if the applicator section on the whole is to consist of one and the same material, manufacture takes place by means of an injection-molding method. For high-quality applicator sections with special usage characteristics, it is alternatively possible to form the ribs 6 by a helical spring that is inserted into an injection-molding tool and then overmolded with the carrier members 5, so that the final result is a one-piece applicator section. In the process, the helical spring is expediently positioned in the injection mold in such a way that each of its ends is embedded into a carrier member. Ideally, the helical spring is made of stainless steel or at least of a non-corroding spring steel, or a spring steel that is coated so as to be non-corroding, but may also optionally be a preferably separately prefabricated plastic component.

For completeness' sake, it is to be noted that the helical spring member does not absolutely have to be round. The use of helical spring members with a polygonal, in particular quadrilateral or triangular or even elliptical or almond-shaped or oval cross section is conceivable. However, a round cross section is clearly preferred, or alternatively a triangular cross section, which exhibits the special advantages already described in the introduction.

FIGS. 25 to 28 show a seventh exemplary embodiment of the invention. This exemplary embodiment differs from the first exemplary embodiment mentioned only by the features that will be described below. Therefore, the statements regarding the sixth exemplary embodiment equally apply to this seventh exemplary embodiment, provided they are not connected to the features from which the seventh exemplary embodiment deviates.

Also in this case, the ribs are formed by a helical spring embedded into the rest of the applicator element. The cross section of this helical spring is not circular. Rather, in the case of this helical spring, the cross-sectional extent of the helical spring, viewed in a direction perpendicular to the longitudinal axis L of the applicator, is greater by at least a factor of 1.5, better by at least a factor of 2, than viewed in the direction parallel to the longitudinal axis L of the applicator. In this way, the helical spring forms ribs that yield to a small extent in the radial direction and that, at the same time, can be clearly perceptibly deflected by the forces of the wiper in the direction parallel to the longitudinal axis of the applicator.

FIGS. 29 to 32 show an eighth exemplary embodiment of the invention.

If there are no contradictions to the special features of this eight exemplary embodiment described below, the above statements pertaining to the sixth exemplary embodiment also apply to this eighth exemplary embodiment.

In this eighth exemplary embodiment, the coupling section 3 and the applicator section 2 are integrally injection-molded from a single plastic material. Ideally, the clear internal cross section of the cage in that case has a slight conicity, i.e. the clear internal cross section of the cage increases slightly towards the distal end of the cage. The wall portions of the cage of this applicator all have substantially the same wall thickness. There are wall portions of the cage in some regions which are not perforated and which form the carrier members 5 in this manner.

Two carrier members 5, respectively, are connected to each other by means of ribs 6 that respectively extend from one carrier member to the other carrier member—also in this case, each rib has a first rib base point 8, with which it transitions into a first carrier member, and a second rib base point 9, with which it transitions into a second carrier member. The ribs 6 are spaced apart from each other, so that, in accordance with the definition given in the introduction, a passage 7 is formed, respectively, between two ribs that are adjacent in the direction of the longitudinal axis L.

Each of the ribs has a convex outer surface with a radius of curvature that is smaller than the radius of curvature of the imaginary circle enveloping the cross section. Thus, each row of ribs that are disposed one behind the other in the longitudinal direction L forms a substantially convex bulge which protrudes outwards and which comprises a number of passages 7 that communicate with the interior of the cage and into which the eyelashes insert themselves during application.

In slightly different words, the ribs in this design are characterized in that their base points 8 and 9 (relative to the longitudinal axis of the applicator) each lie on a smaller diameter than their apex 10.

This provides the cross section of the cage with a "blossom-like" look. On their outsides, the individual ribs themselves thus have a comparatively strong convex curvature and can thus be brought relatively close to the end of the eyelashes on the side of the lid, even though the diameter of the applicator section determining the maximum stored amount is, on the whole, relatively large. An additional result is the channels 11, which extend on the outer circumference of the applicator section in the direction parallel to the longitudinal axis L, and which are not subjected to the effects of a substantially circular wiper, and in which, therefore, an increased portion of cosmetic mass can be stored, see FIG. 13. On the whole, this results in a special, advantageous application behavior. At the same time, such a cross section design facilitates the shaping of the applicator section after its production in an injection-molding process.

Figure 10:
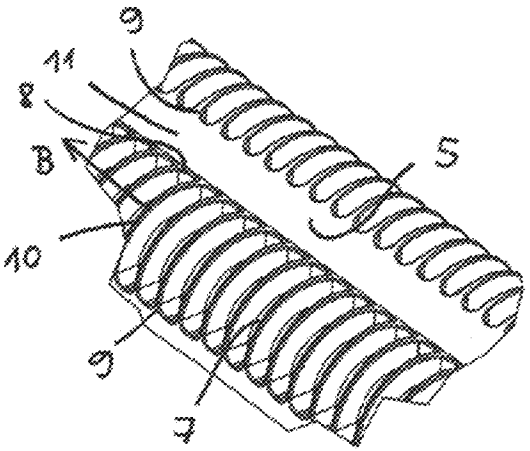
FIG. 10 is a magnified view of FIG. 9.
Figure 12:
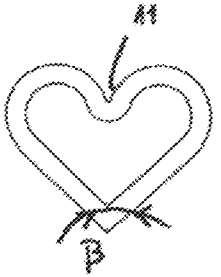
FIG. 12 is an end view of the device of FIG. 9.
Figure 9:
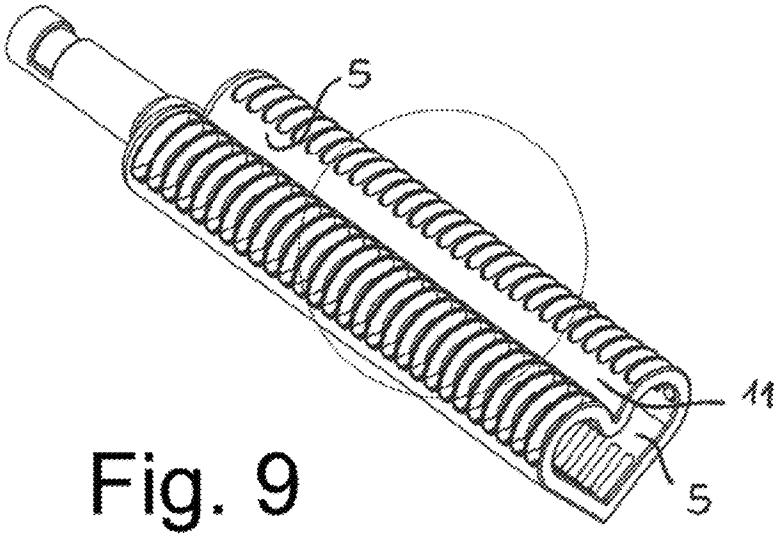
FIG. 9 is a perspective view of a third embodiment with a heart-shaped cross-section.
Figure 15:
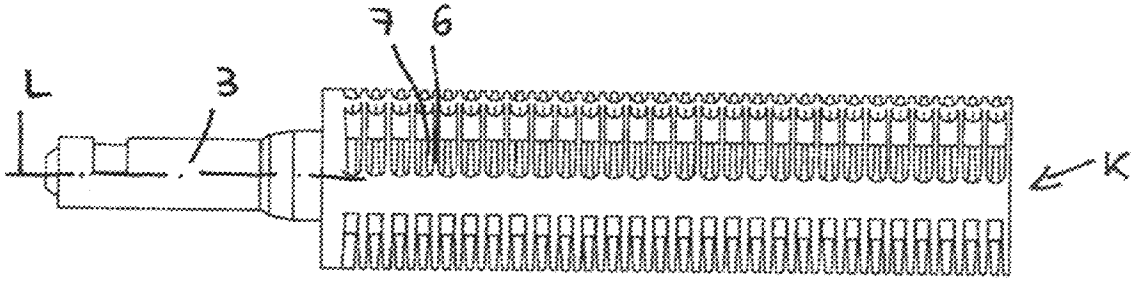
FIG. 15 is a side view of the device of FIG. 13.
Figure 14:
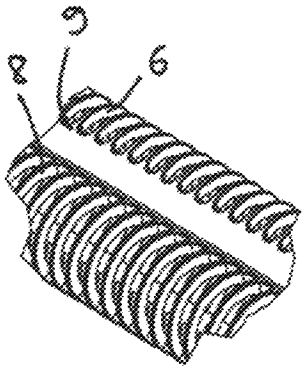
FIG. 14 is a magnified view of FIG. 13.
Figure 16:
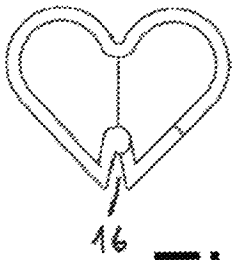
FIG. 16 is an end view of the device of FIG. 13.
Figure 13:
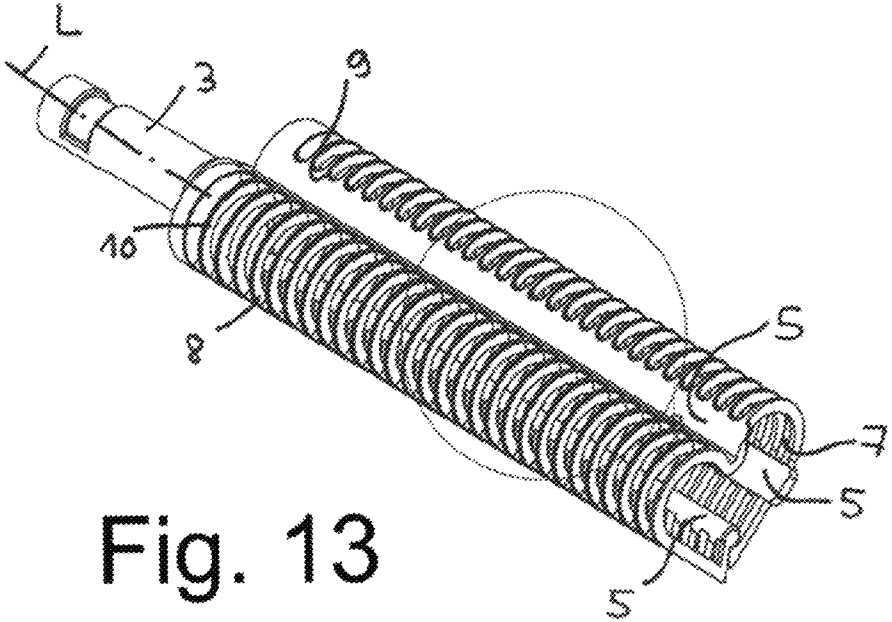
FIG. 13 is a perspective view of a fourth embodiment with a heart-shaped cross-section.
Figure 19:
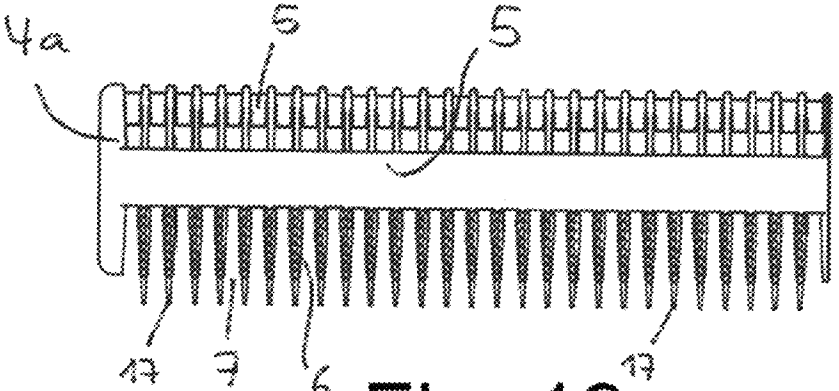
FIG. 19 is a side view of the device of FIG. 17.

It is also to be noted that, as FIG. 10 shows, an offset is provided between ribs 6 that are consecutive in the circumferential direction. Preferably, a preceding rib respectively lies centrally on the imaginary circumferential line that divides the passage 7 exactly, or at least approximately, centrally between two subsequent adjacent ribs 6, see FIG. 31.

In this exemplary embodiment, the rib spacing RA is at least 1.5 times, better yet at least 2 times, the rib diameter or rib extent RD, measured in the direction parallel to the longitudinal axis L.

The cross section of the individual ribs is preferably rectangular in this case. The cross-sectional surface area of the individual ribs can preferably be selected to be so small, in accordance with the material used for the ribs, that the individual ribs are not completely rigid, but that they can be bent a bit towards the side in the direction of the longitudinal axis L of the applicator by the wiper during wiping, similar to what was already described above for the first exemplary embodiment. However, the ribs in this exemplary embodiment are preferably characterized in that they are virtually rigid, that, under the influence of the forces of the wiper, they yield only by a measure B that is smaller than their rib extent RD in the longitudinal direction. The individual ribs are in this case formed as arcs of a circle, similar to the two previously mentioned exemplary embodiments.

FIGS. 33 to 36 show a tenth exemplary embodiment of the invention. It completely matches the sixth exemplary embodiment, so that the statements made there apply here in an identical manner.

The difference to the sixth exemplary embodiment lies in two things.

The carrier members 5 are equipped with retaining means 18 that protrude radially outwards and that increase the adherence of the cosmetic mass to the carrier member and/or that serve for combing or separating.

In a comparable manner, the ribs 6 are provided with further retaining means 19 in the form of protrusions protruding from the ribs. Depending on their orientation, these further retaining means 19 serve the same purpose as the retaining means 18. If orientated primarily in the longitudinal direction, then they can also serve for retaining the eyelashes between the ribs and thus facilitate a better curling action.

In general, and applicable for all exemplary embodiments, a series of essential aspects are now to be summarized again below:

According to the invention, the applicator section is configured as an internally hollow cage for accommodating the cosmetic, which is substantially or preferably completely closed in the circumferential direction. Once this cage is pushed into a supply of the cosmetic to be applied, the cosmetic enters the cavity enveloped by the cage and loads the cage also from the inside with the cosmetic to be applied—even if the cosmetic is so liquid that it largely flows out of the interior of the cage again when the cage is pulled out of the supply, the surface of the inside of the cage also contributes to retaining additional cosmetic that is later available for application. Preferably, the dimensioning of the cavity and the viscosity of the cosmetic are matched to each other in such a way that about ⅓ or preferably even the predominant part of the cosmetic which has previously entered the cavity remains there also after withdrawal and wiping.

In this case, the cage is configured in such a manner that it comprises on its circumference a number of passages for the eyelashes that are situated one next to the other in the direction of the longitudinal axis of the applicator, via which the eyelashes can enter the interior of the cage when the cage is brought up close to the eye. If the applicator is used for applying a higher-viscosity, in particular gel-like or pasty cosmetic, then the eyelashes come into contact with the cosmetic still stored inside the cage once they have passed the passages; otherwise, they will in any case come into contact with the cosmetic still stored on the cage surface. In any case, they will be wetted lengthwise with the cosmetic once they move relative to the passages because the cage is turned and/or pulled back again from the eye.

Such a construction of the applicator, depending on the design of the applicator in the specific individual case, offers various advantages. Due to the omission of the core, it is thus possible to configure the applicator section with a smaller external diameter than is known from disk applicators, without affecting the mass storage capacity familiar from the disk applicators. Due to its smaller external diameter, such an applicator section can be brought up closer to the end of the eyelashes on the side of the lid, whereby a really complete treatment of the eyelashes, directly up to their point of attachment on the side of the lid, is facilitated.

If, however, one abstains from reducing the external diameter of the applicator section compared with the disk applicator, then an applicator section with an extraordinarily large mass storage capacity with a very small applicator diameter is obtained. In individual cases, this can also be an advantage, particularly when using a cosmetic mass whose viscosity is so high that a part of the cosmetic mass remains stored in the interior of the cage even after the withdrawal and wiping of the applicator.

Preferably, the passages, viewed in the circumferential direction, extend without interruption over an arc that corresponds to an angle $\alpha$ of at least 40°, better an angle $\alpha$ of at least 80°, and ideally an angle $\alpha$ of at least 100°. In this manner, extremely long slots are obtained, viewed in the circumferential direction, which make it easier for the eyelashes to enter, also in a steep manner if necessary, the inside of the cage and to come into contact with the mass stored therein.

In another preferred embodiment, it is provided that that the passages constitute at least 25%, better at least 50%, and ideally more than 65% of the surface area that the enveloping jacket surface possesses. This measure also considerably facilitates the entry of the eyelashes into the interior of the cage. The danger that many eyelashes do not come across a passage and cannot be threaded into the interior of the cage, but that they, as it were, bounce off the surface of a rib and are repelled by it is significantly reduced.

In connection with another preferred exemplary embodiment, it is provided that the distal end face of the applicator section comprises an opening through which a cosmetic is pushed into the interior of the cage during the insertion of the applicator, wherein the cross-sectional surface area of the opening constitutes preferably at least 50%, better at least 75% of the surface area taken up by the distal end face. Such a generous opening facilitates the entry of the cosmetic into the interior of the cage.

In the context of another preferred exemplary embodiment, it is provided that the proximal end face of the applicator section is completely or at least largely closed. The crucial advantage of such a design is that, even when the cage is not completely filled, the cosmetic mass pushed into the interior of the cage backs up on this proximal end face and is not pushed out of the cage in the direction of the applicator stem.

Another preferred embodiment provides that the applicator section comprises several carrier members preferably extending substantially in the direction parallel to the longitudinal axis, which are interconnected by spaced-apart ribs, the ribs forming passages between them and the ribs preferably consisting of a material that is so flexible that the ribs bend by a certain measure in the direction parallel to the longitudinal axis under the influence of the forces applied to them by a wiper.

Preferably at least a part of the carrier members is configured to be so strong that these carrier members are not, or not substantially, deformed under the influence of the forces applied to the cage by the wiper when the cage passes through a wiper. It is ensured in this manner that the cage is rather rugged in order not to be permanently deformed or even destroyed by the wiper. Instead, the carrier members guarantee that the cage reassumes the shape it has been given by the manufacturer after its passage through the wiper.

Preferably, the spacing of two ribs adjacent in the direction parallel to the longitudinal axis is greater than the extent of an individual rib in the direction parallel to the longitudinal axis, preferably by at least a factor of 1.5, ideally by at least a factor of 2. In this way, it is ensured that passages are made available for the eyelashes that are as large as possible, so that the majority of the eyelashes actually enter the interior of the cage.

It is particularly advantageous to provide the applicator according to the invention for applying a cosmetic to eyelashes with a shaft section or at least a coupling section and an applicator section, the applicator section being configured as an internally hollow cage for accommodating the cosmetic, which is substantially or completely closed in the circumferential direction, and which comprises passages that communicate with the interior of the cage and into which the eyelashes insert themselves during application, wherein the applicator comprises cantilever arms for acting on the eyelashes or eyelash grippers, which freely protrude from the cage with one end thereof.

FIGS. 37 to 40 show another exemplary embodiment of the invention.

This exemplary embodiment is related to some degree to the first exemplary embodiment.

As can be seen, the actual applicator 1, also in this case, is comprised of an applicator section 2 in the shape of the preferably completely core-less cage K, which is to be explained in detail below, and a coupling section 3. The applicator 1 is coupled by means of the coupling section 3 to a stem, which is not shown here and which establishes a connection with a handle, which is also not shown here.

The proximal end face 4*a* of the applicator section 2, i.e. the end face facing towards the coupling section 3, is adjacent to the coupling section 3. A cage with a hexagonal cross section, which is to be described later, is integrally molded on to this proximal end face 4*a* in this exemplary embodiment. The proximal end face 4*a* is completely closed and thus retains the cosmetic mass entering the cavity of the cage K. The distal end face 4*b* of the applicator section is substantially completely open and thus offers a large cross section via which the cosmetic mass can enter the interior of the cage K when the applicator section 2 is dipped or pushed in again.

The closed cage characterizing this exemplary embodiment, with its cross section which is preferably hexagonal on its outer circumference, is immediately noticeable.

The coupling section 3 and the applicator section 2 of this exemplary embodiment can be integrally injection-molded from a plastic material. Ideally, the clear internal cross section of the cage in that case has a slight conicity, i.e. the clear internal cross section of the cage increases slightly towards the distal end of the cage.

In this exemplary embodiment, the cage has no carrying structures that are formed continuously in the direction of the longitudinal axis. Instead, the cage consists of a number of rings Ri that extend substantially in the circumferential direction and leave passages free between them that form the access to the interior region of the cage. Adjacent rings Ri are connected to each other via several, preferably six, struts St that extend obliquely to the longitudinal axis. In this manner, the passages, viewed from the inside of the cage, are given an almond-shape by being delimited by two lines that are convex towards the outside of the passage and that intersect at two points. Moreover, passages are being produced in this manner, relative to the longitudinal axis, whose center line—projected onto the longitudinal axis—does not extend orthogonally thereto but inclined thereto by at least 10 degrees, better by at least 15 degrees. According to the Figures, this configuration results in the applicator, in the region of its circumferential tips, or beyond its circumferential tips, comprising a number of passages that communicate with the interior of the cage and into which the eyelashes insert themselves during application.

The rings Ri are preferably characterized in that their inside extent in the direction parallel to the longitudinal axis L is greater than the inside extent of the struts St in the same direction, preferably by at least a factor of 2.0.

Ideally, said rings and preferably (but not always) also said struts are configured in such a way that their extent in the direction of the longitudinal axis decreases in the radially outward direction, so that they most frequently have a V-shaped cross section.

Preferably, the struts St are dimensioned to be so thin that they are able to yield in an elastically resilient manner under the influence of the forces occurring during application. This renders the applicator to be yielding as a whole; preferably, it can be elastically resiliently compressed a bit (ideally at least 10%, better at least 15% of its extent in the direction of the longitudinal axis L), when it is held on a coupling piece attached to the proximal end and when a force that acts in the direction of the longitudinal axis L towards the proximal end is applied from its distal end. Ideally, the applicator is deformed in a concertina-like fashion when subjected to forces in this manner, because the struts St are elastically deformed in such a way that the spacing between adjacent rings Ri becomes smaller.

Protection is sought for this exemplary embodiment also independently from the claims made so far, for example with a claim that reads as worded hereinafter and which is supplemented by further features from the description given for this exemplary embodiment: An applicator 1 for applying a cosmetic to eyelashes, comprising a shaft section or at least a coupling section 3 and an applicator section 2, the applicator section 2 being configured as an internally hollow cage K for accommodating the cosmetic, which is substantially or completely closed in the circumferential direction, characterized in that the cage, in the direction perpendicular to its longitudinal axis L, has a polygonal, ideally hexagonal or octagonal, cross section and comprises in the region of its circumferential tips a number of passages that communicate with the interior of the cage and into which the eyelashes insert themselves during application.

Irrespective of the individual exemplary embodiments, the term "eyelashes" in this patent application is generally preferably understood in its strict sense, i.e. as "eyelashes of the human eye". However, even though this is not preferred, protection is also sought for such claims in which the term "eyelashes" is defined more broadly, i.e. generally as "keratin fibers", so that applicators configured in accordance with the invention, e.g. for dyeing hair on top of the head, come under the set of claims. The limitation to the core of the invention, which relates to applicators for eyelashes in the strict sense, remains reserved.

For all applicators described in this application, it preferably applies that the maximum external diameter of the applicator section is <10 mm and ideally <7 mm. As a rule, the applicators according to the invention are thus very delicate structures.

The invention claimed is:

1. An applicator for applying a cosmetic to eyelashes, comprising:

a coupling section; and an applicator section joined to the coupling section, the applicator section being configured as an internally hollow cage for accommodating the cosmetic, wherein the cage is substantially or completely closed in a circumferential direction and a proximal end face of the applicator section joined to the coupling section is completely closed, and the cage, in a direction perpendicular to a longitudinal axis of the applicator section, has a triangular cross section;

wherein the cage is formed by three carrier members that are attached to the closed proximal end face and extend in a direction substantially parallel to the longitudinal axis of the applicator section, with adjacent carrier members connected to each other through a plurality of spaced-apart ribs which form passages between the ribs, with each of the ribs extending from a base point on one carrier member, through an apex, to a base point on the adjacent carrier member; and wherein a width of each rib measured in the direction parallel to the longitudinal axis of the applicator section decreases from the base points towards the apex wherein a spacing of two ribs adjacent to one another in the direction parallel to the longitudinal axis is greater than the width of each of the two adjacent ribs in the direction parallel to the longitudinal axis, by at least a factor of 1.5.

2. The applicator according to claim 1, wherein the passages constitute at least 25% of the surface area that an enveloping jacket surface that would cover an entire surface area of the cage, including the carrier members, ribs, and passages between the ribs, possesses.

3. The applicator according to claim 1, wherein a distal end face of the applicator section opposite the proximal end of the applicator section comprises an opening through which cosmetic is pushed into the interior of the cage during insertion of the applicator into a cosmetics storage container, wherein a cross-sectional surface area of the opening constitutes at least 50% of the surface area of the distal end face.

4. The applicator according to claim 1, wherein at least a part of the carrier members is configured to be sufficiently strong to prevent permanent deformation of the carrier members when the cage passes through a wiper attached to a container into which the applicator is inserted and withdrawn during use.

5. The applicator according to claim 1, wherein a transverse cross section of each of the carrier members is respectively greater than a transverse cross section of each of the ribs.

6. The applicator according to claim 1, wherein a cross section of at least a plurality of the ribs has a greater width in a radial direction than in the direction parallel to the longitudinal axis.

7. An applicator for applying a cosmetic to eyelashes, comprising:

a coupling section; and an applicator section joined to the coupling section, the applicator section being configured as an internally hollow cage for accommodating the cosmetic, wherein the cage is substantially or completely closed in a circumferential direction and a proximal end face of the applicator section joined to the coupling section is completely closed, and a cross section of the cage comprises, perpendicular to a longitudinal axis of the applicator section, at least one substantially V-shaped bulge having two surfaces disposed at an angle to each other of ≤110°, which protrudes outwards from the longitudinal axis in the circumferential direction, wherein the cage is formed by three carrier members that are attached to the closed proximal end face and extend in a direction substantially parallel to the longitudinal axis of the applicator section, with adjacent carrier members connected to each other through a plurality of spaced-apart ribs which form passages between the ribs, with each of the ribs extending from a base point on one carrier member, through an apex, to a base point on the adjacent carrier member; and wherein a width of each rib measured in the direction parallel to the longitudinal axis of the applicator section decreases from the base points towards the apex wherein the passages, viewed in the circumferential direction, extend without interruption over an arc that corresponds to an angle of at least 40°.

8. The applicator according to claim 7, wherein the passages constitute at least 25% of the surface area that an enveloping jacket surface that would cover an entire surface area of the cage, including the carrier members, ribs, and passages between the ribs, possesses.

9. The applicator according to claim 7, wherein a distal end face of the applicator section opposite the proximal end of the applicator section comprises an opening through which cosmetic is pushed into the interior of the cage during insertion of the applicator into a cosmetics storage container, wherein a cross-sectional surface area of the opening constitutes at least 50% of the surface area of the distal end face.

10. The applicator according to claim 7, wherein at least a part of the carrier members is configured to be sufficiently strong to prevent permanent deformation of the carrier members when the cage passes through a wiper attached to a container into which the applicator is inserted and withdrawn during use.

11. An applicator for applying a cosmetic to eyelashes, comprising:

a coupling section; and an applicator section joined to the coupling section, the applicator section being configured as an internally hollow cage for accommodating the cosmetic, wherein the cage is substantially or completely closed in a circumferential direction and a proximal end face of the applicator section joined to the coupling section is completely closed, and wherein the cage comprises two carrier members that are attached to the closed proximal end face and extend in a direction substantially parallel to a longitudinal axis of the applicator section, and the carrier members are connected to each other through a plurality of spaced-apart ribs that extend from one carrier member to the other carrier member forming passages between the ribs that communicate with an interior of the cage and into which the eyelashes insert themselves during application, and the ribs are formed by a helical coil consisting of metal that is overmolded with plastic along with the carrier members wherein a transverse cross section of each of the carrier members is greater than a transverse cross section of each of the ribs.

12. The applicator according to claim 11, wherein a cross section of at least a plurality of the ribs has a greater width in a radial direction than in the direction parallel to the longitudinal axis.

* * * * *